US005154208A

United States Patent [19]

Derudder

[11] Patent Number: 5,154,208

[45] Date of Patent: Oct. 13, 1992

[54] LANCET HOLDER FOR FACE TO FACE LOOM

[75] Inventor: Carlos Derudder, Kortrijk, Belgium

[73] Assignee: N.V. Michel Van de Wiele, Kortrijk/Marke, Belgium

[21] Appl. No.: 703,677

[22] Filed: May 21, 1991

[30] Foreign Application Priority Data

May 21, 1990 [BE] Belgium ..... 09000536

[51] Int. Cl.[5] ..... D03D 49/62; D03D 39/16

[52] U.S. Cl. ..... 139/37; 139/46; 139/192

[58] Field of Search ..... 139/1 C, 192, 46, 11, 139/21, 37

[56] References Cited

U.S. PATENT DOCUMENTS 1,691,194 11/1928 Howard .
2,808,072 10/1957 Stovall .
4,721,135 1/1988 Tsubata et al. ..... 139/46
4,892,120 1/1990 Bostyn ..... 139/21

FOREIGN PATENT DOCUMENTS 1535806 8/1969 Fed. Rep. of Germany ..... 139/46
792461 12/1935 France .

*Primary Examiner*—Andrew M. Falik
*Attorney, Agent, or Firm*—James Creighton Wray

[57] ABSTRACT

Lancet holder for face-to-face weaving loom, comprising a slat-shaped section (1) onto which lancets (2) can be pushed. A comb (4) with teeth (8) lies directly in front of section (1). Each lancet (2)—extending in the warp direction—can be situated between two teeth (8), and the width of the space between two teeth (8) is slightly greater than the thickness of a lancet (2), so that they remain with their flanks at right angles to the section (1). Section (1) and part of the lancets (2) pushed onto it may be enclosed by a surrounding wall (9), (10) which is rounded off and smooth along the outside, and the comb (4) is set up along the front open side of said surrounding wall, so that the lancets (2) can extend from the enclosed space between the teeth (8).

12 Claims, 2 Drawing Sheets

LANCET HOLDER FOR FACE TO FACE LOOM

The present invention relates to a holder for lancets which forms part of a face-to-face weaving loom, and is equipped to carry a large number of lancets which extend between top fabric and bottom fabric in order to hold the said fabrics at a certain distance from each other, said lancets in this way determining the pile height of said fabrics.

Such lancets and their holders are known. Each lancet in a commonly occuring embodiment comprises an elongated piece of flat steel with a height which is double that of the desired pile height on each fabric and a low thickness. One end of each lancet is provided with an elongated slit-shaped opening extending along the lengthwise direction of the lancet and passing through the lancet, coming out in the lateral flanks with height. The other end of each lancet ends in a pointed shape through the gradual and symmetrical reduction of the height of the two flanks. These lancets are arranged next to each other with their flanks with height vertical and each extending in the warp direction, in such a way that they are situated between the woven top piece and bottom piece, carried by a horizontal section which extends through the slit-shaped openings of all lancets and is firmly fixed to the weaving loom, extending in the weft direction. All lancets are consequently pushed parallel to each other and next to each other onto the section. The length of each slit-shaped opening is greater than the width of the horizontal section sitting through said openings. Each lancet is also made slightly curved over the length in which the slit-shaped opening is provided, in a direction at right angles to the side flanks in a symmetrical circular arch, so that the two ends of each lancet lie in line with each other. This bending also means that the edge of each slit-shaped opening resting on the section is also laterally curved in a circular arch and consequently forms a bearing face lying outside the center of gravity along one side and preventing the lancet from easily tilting on the bearing section. The above-mentioned section bearing the lancets is slat-shaped and is itself carried by means of holders each containing the section along the bottom side and the front side (fabric side). These holders are also fixed by means of bolts or similar means on another section. This section is the shape of an inverted U and is connected to the frame of the weaving loom.

A disadvantage of this device lies in the fact that, despite their laterally curved bearing faces, the lancets still tilt.

Another disadvantage is the fact that the lancets can shift along the lengthwise direction of the bearing section on said section, and bunch together during weaving.

Yet another disadvantage of this device is the fact that an adequate number of holders has to be provided—distributed over the length of the section—in order to prevent this section from sagging in a vertical plane, under the influence of its own weight and the weight of the lancets, and in a horizontal plane in the wrap direction, under the influence of the tensile forces which the lancets undergo as a result of the advance of the fabric.

An additional disadvantage is also the fact that the pile threads which have to pass below or above the device described above can come into contact with the slat-shaped bearing section, the section holders and/or their fixing bolts, and the U-shaped section connected to the frame, and can stick on these, since these parts are not smooth and have sharp edges. One of the situations where problems occur as a result is when use is made of tension control in the threads.

The object of the invention is to provide a lancet holder for face-to-face weaving looms in which the above-mentioned disadvantages cannot occur, in the case of which, in other words, the lancets cannot shift laterally, cannot tilt, and in the case of which the threads just below or above the device can come into contact only with smooth and rounded surfaces and edges, and where sagging of the section, both in a vertical and in a horizontal plane is prevented, without making use of special holders or fixing means which hold the section at different points relative to the weaving loom.

The subject of the invention is a lancet holder comprising a slat-shaped section onto which the lancets are pushed, each lancet having a slit-shaped opening through which the said section extends, as in the case of the known device described above, but characterised in that a comb, preferably of metal, extends at the level of said lancets, just before the slat-shaped section and parallel thereto. A slit, with a width which is slightly greater than the thickness (e) of a lancet, is provided between every two vertical teeth of this comb, while the distance between two adjacent slits corresponds to the distance between two adjacent gaps in the reed, or is a multiple of that distance. The width of the slit between every two teeth is such that a lancet can be situated in said slit, with the flanks standing vertically, and extending at right angles to the lengthwise direction of the comb, and due to the vertical teeth it is impossible for it to tilt.

The comb is set up in such a way that all lancets can extend between two teeth of the comb.

The lancet holder according to the invention is also characterised in that the rear side of all lancets—the part which is provided with a slit and is located behind the comb and slid onto the slat-shaped section—is enclosed by a surrounding wall. This wall extends at least above and below the rear end of the lancets sitting on the slat-shaped section—over the entire length thereof—and can also form a vertical rear wall extending downwards along the rear ends of the lancets, while this wall has front edges abutting the comb along the bottom and along the top, and while the vertical distance between said front edges must be greater than the height (h) of the lancets extending between the comb teeth out of the space enclosed by the wall.

The lancet holder according to the invention is further characterised in that any connecting means between the different parts—such as bolts, screws and similar menas—are located along the rear side of the lancet holder, viewed from the direction of the fabric, and in that the external surfaces of the lancet holder are made smooth and have rounded edges.

The lancet holder according to the invention is also characterised in that the comb is connected to at least one edge of the enclosing wall by means of bolts, screws or similar means, and in that a raised edge of the enclosing wall along the bottom serves as a bearing face for the lancets, while a top part of the wall through its connection with bolts or similar means forms an easily removable cover of the enclosed space.

An advantage of the lancet holder according to the invention is the fact that, on the one hand, the slat-shaped section and the rear ends of the lancets slid onto it are completely enclosed and that, on the other, the outsides of the enclosing walls are made smooth and rounded, and any bolts, screws or similar parts are situated along the back, which means that sticking of the yarns is avoided.

Another advantage of the lancet holder according to the invention is the fact that the comb ensures that the lancets cannot shift and bunch up and cannot tilt either, as a result of which, inter alia, their laterally curved design becomes superfluous.

Yet another advantage of the lancet holder according to the invention is the fact that the enclosing wall, as it were, forms a box in which the section and the comb are fixed, while the lancets, on the one hand, are supported by the section and, on the other, rest on a raised edge of the enclosing wall, and so that the strength of the enclosing wall prevents the section from sagging in a vertical plane.

Due to the fact that the slat-shaped section rests against the comb (see FIG. 1), and due to the fact that said comb is belted to the bottom part of the lancet holder, which has good resistance against bending in a horizontal plane, the above-mentioned sagging of the section in a horizontal plane is prevented.

Further features and advantages of the lancet holder according to the invention will emerge from the detailed description below of a preferred embodiment of a lancet holder according to the invention, without the invention being thereby restricted to this possible embodiment. This description is illustrated by means of the figures appended hereto, in which.

Figure 1:
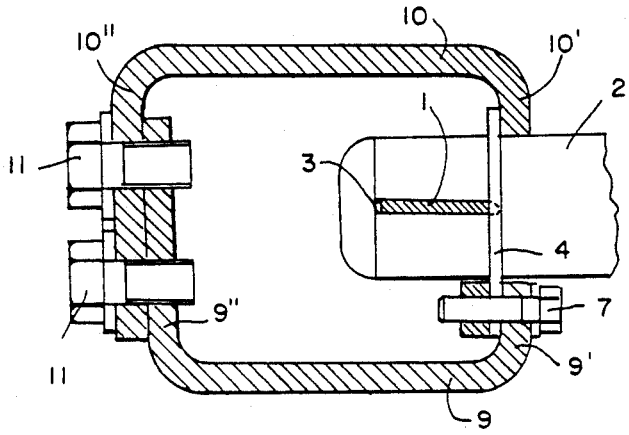
FIG. 1 represents a vertical cross-section of the lancet holder according to the invention, in which only the rear part of the lancets is shown.
Figure 3:
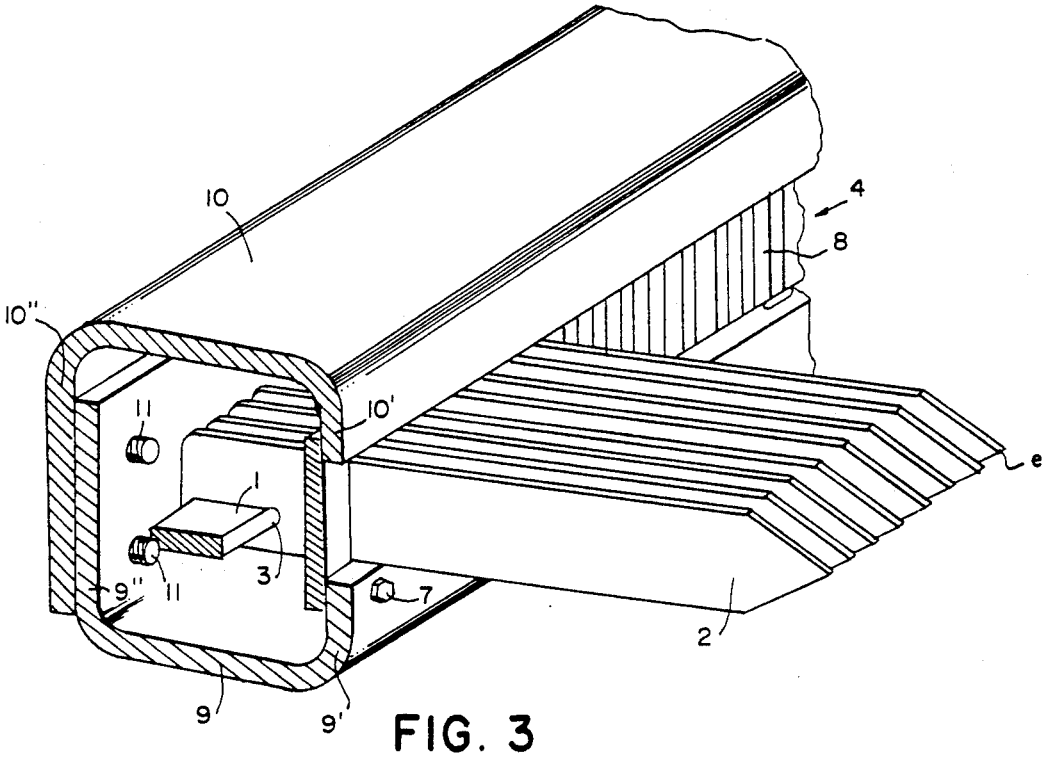
FIG. 3 shows in perspective a cross-section of a part of the lancet holder according to the invention, in which only a few lancets are partially shown.
Figure 2:
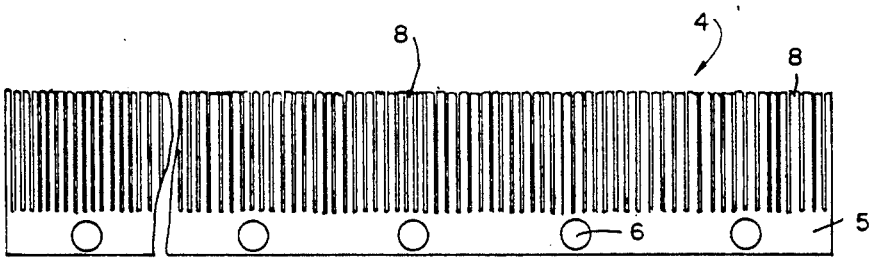
FIG. 2 represents a front view of the comb of the lancet holder according to the invention.

The lancet holder according to the invention comprises a slat-shaped section (1) which is fixed by known means to the lancet holder which extends horizontally in the weft direction. All lancets (2) are slid onto this slat-shaped section (1), in such a way that the slat-shaped section (1) passes through the slit-shaped openings (3) in the rear ends of all lancets (2).

The lancet holder according to the invention contains a comb (4) at the level of the lancets (2). This comb (4) is disposed against the slat-shaped section (1). This comb (4) comprises a bottom continuous part (5) provided with holes (6) for fixing by means of bolts (7), while vertical teeth (8) of equal length and thickness run from the top of said part (5), and between every two teeth a space is provided which is a little broader than the thickness (e) of a lancet (2). This comb (4) is disposed vertically against the slat-shaped section (1), in such a way that each lancet (2) can extend between two adjacent teeth (8). The lancets (2) lie in a direction at right angles to said comb (4). The length of comb (4) is such that all lancets (2) located over the total length of the slat-shaped section (1) can extend between the teeth (8) of the comb (4).

The lancet holder according to the invention comprises two enclosing sections (9) and (10) which are identical in shape. The shape of these sections is that of an elongated C-section with a short leg (9') and (10') and a longer leg (9'') and (10''). Both sections (9) and (10) are connected to each other by means of bolts (11), screws or similar means, with the long legs (9'') and (10'') lying vertically against each other. These sections are equal in length and are situated above each other in the horizontal position, with the trough-shaped side facing each other, and they consequently form an enclosing wall. The top face and bottom face of the enclosing wall is formed by the horizontal parts of the sections (10) and (9), while the rear vertical face is formed by the long legs (9'') and (10'')—lying against each other and connected to each other - of the sections (9) and (10). The front side of the enclosed space is open between the vertical short legs (9') and (10') of the sections (9) and (10) facing each other.

The interconnected sections (9) and (10) are now disposed and fixed on the weaving loom in such a way that the slat-shaped section (1) over its entire length—and thus also all rear ends of the lancets (2) pushed onto it—comes to lie inside the space enclosed by the sections (9) and (10). The lancets (2) extending further forward leave the enclosed space along the open front edge, which must consequently be higher than the height (h) of a lancet (2). The lancets (2) extend between the teeth (8) of the comb (4), while the latter with its continuous part (5)—over the entire length—comes to rest against the flank of the bottom upright short leg (9'), along the inside of the enclosed space, and is fixed thereto by means of bolts (7) or similar means passed through the holes (6) in the continuous part (5) of the comb (4) and horizontally through the flank of the short leg (9') of the bottom enclosing section (9). With this arrangement of the comb (4) the top ends of the teeth (8) come to lie against the flank of the short leg (10') of the top section (10), also along the inside of the enclosed space.

The lancet holder according to the invention is further characterised in that the distance between two adjacent slits in the comb (4) corresponds to or is a multiple of the distance between two spaces in the reed of the weaving loom.

Another feature of the lancet holder according to the invention is that the walls of the enclosing sections (9) and (10) are made smooth, and that the corners thereof are rounded, and that the connecting bolts or similar means which connect said two sections (9) and (10) are situated along the rear side of the lancet holder, viewed from the fabric side.

An advantage of the lancet holder according to the invention lies in the fact that the lancets (2) are held in place by the teeth (8) of the comb (4), and thus cannot shift laterally during the weaving, and are not going to bunch together at a certain point. Consequently, the arrangement of the lancets remains well distributed over the total width of the fabric.

Another advantage of the lancet holder according to the invention lies in the fact that the lancets (2) cannot possibly tilt now on the slat-shaped section (1), due to the fact that the widths of the slits between the teeth (8) of the comb (4) are only slightly wider than the thickness (e) of a lancet (2).

Figure 4:
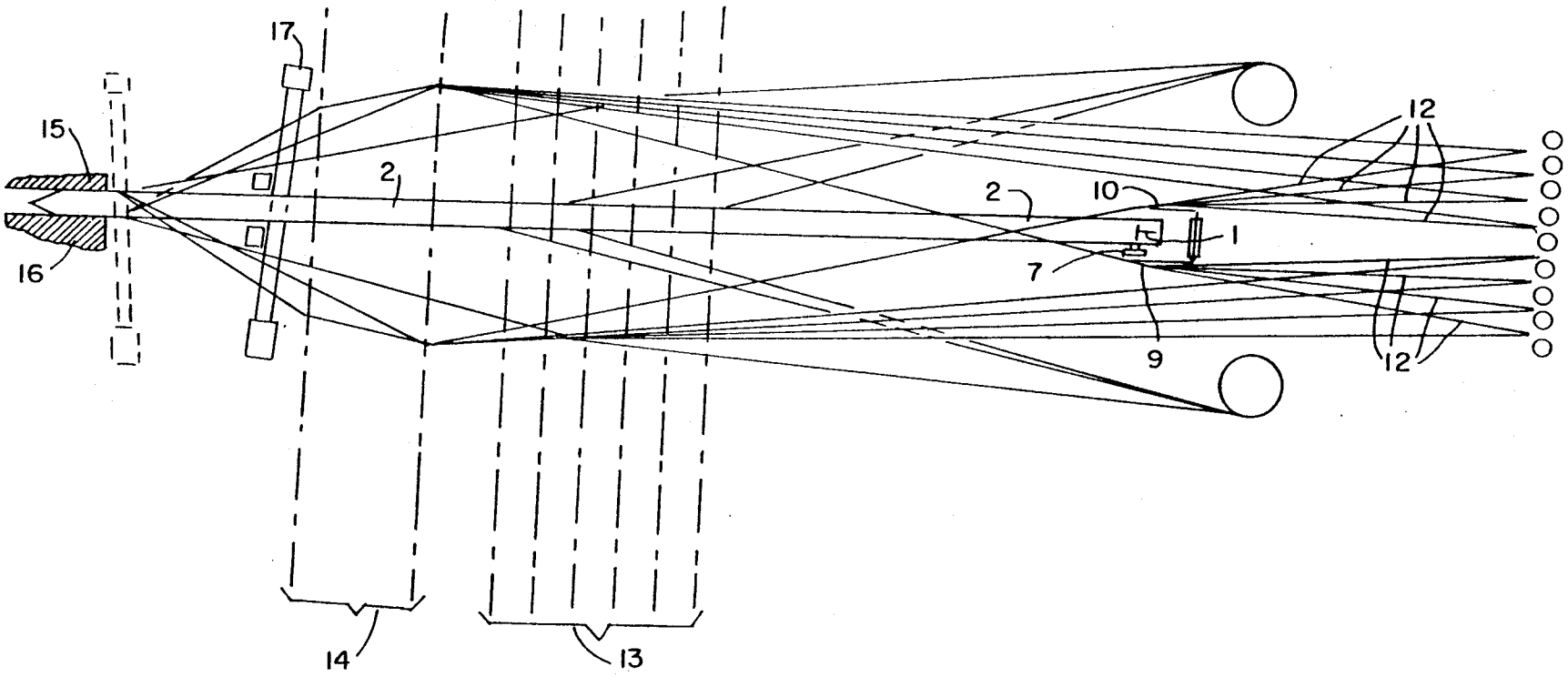
FIG. 4 shows in side sectional view the position of the lancet holder, according to the invention, in relation to the weaving machine.

An additional advantage of the lancet holder according to the invention (see FIG. 4) in the fact that the yarns (12), passing through reed 17, which have to extend directly below or above the lancet holder no longer stick on projecting parts (such as bolts etc.) or uneven surfaces or sharp edges, due to the fact that all corners of the sections (9) and (10) are rounded off along the outside, on account of the fact that the external surfaces are made smooth, and through the fact that the heads of the bolts (7) or similar means connecting the two sections (9) and (10) are at a place which cannot be reached by the yarns (12) (along the rear side of the lancet holder, viewed from the fabric), and through the fact that both the rear side of the lancets (2) and the slat-shaped section (1) onto which said lancets (2) are pushed are enclosed by the sections (9) and (10), so that these parts also cannot impede the yarns. In FIG. 4, the dashed lines are indicating the position of the shafts (13) and the harness (14) of the weaving machine. A lancet (2) is extending from the lancet holder between the top fabric (15) and the bottom fabric (16).

An additional advantage which follows from the fact that the lancets (2) can no longer tilt lies in the fact that these lancets can now be made completely flat and no longer need a lateral bend in order to increase their stability.

Another advantage of the invention follows from the fact that, on the one hand, the section (1) is disposed against the comb (4) and that, on the other, the lancets (2) rest on the short upright leg (9') of the enclosing section (9). The above-mentioned advantage actually lies in the fact that the lancet holder (9, 10) constitutes a stiff cross-beam by which the section (1) thereby receives an additional resistance to bending both in a vertical plane—through its own weight and the weight of the lancets—and in a horizontal plane in the warp direction—through the advance of the fabric—, so that no separate holders or similar means have to be provided to hold the section relative to the weaving loom in order to prevent such sagging.

I claim:

1. Lancet holder for face-to-face weaving loom comprising plural lancets (2), each having a slit-shaped (3) opening at a rear end, a horizontal slat-shaped section (1) being insertable through the slit-shaped openings of each lancet, each of the lancets having a flank at right angles to the slat-shaped section and further wherein the slat-shaped section and the rear end of each lancet are enclosed by a surrounding wall, characterised in that the surrounding wall is formed by two elongated C-sections including a bottom section (9) and a top section (10), each with a short leg (9') and (10') and a longer leg (9'') and (10''), said C-sections are connected to each other by means of detachable fixing means, with the long legs (9'') and (10'') lying vertically against each other, in such a way that the short leg (9') of the bottom section (9) is directed vertically upwards and the short leg (10') of the top section (10) is directed vertically downwards and lies in line with the short leg (9'), in such a way that both the top and the bottom sections (9), (10) enclose a symmetrical tubular space with an open front side between the two short legs (9') and (10').

2. Lancet holder for face-to-face weaving loom according to claim 1, characterised in that a comb (6) comprising teeth (4) directed vertically upwards from a base of the comb is fixed to the flank of the short leg (9') of the bottom section by bolt means which pass through plural holes (6) in the base of the comb (4) and pass through the short leg (9').

3. Lancet holder for face-to-face weaving loom forming a top and bottom fabric, comprising a number of flat, or laterally curved, thin lancets (2) each lancet being provided with a slit-shaped opening (3) proximal to a rear end of each lancet; said holder comprising a horizontally disposed slat-shaped section (1), onto which the lancets (2) have been inserted and further comprising a comb including a base (4) with vertical teeth (8) which is disposed parallel to the slat-shaped section (1), such that the lancets (2) extend in the loom warp direction to a distance until a front end of each lancet is between the top, and bottom fabrics each lancet (2) rests with a raised flank in a different space between two adjacent teeth (8), a width of each space between adjacent teeth (8) being little greater than a thickness of the lancet (2) and the horizontal distance between two adjacent spaces between adjacent teeth (8) corresponding to or being a multiple of the space between plural vertical gaps in a reed of the weaving loom, characterised in that the lancet holder is provided with a housing which encloses the slat-shaped section (1) and the rear ends of the lancets inserted onto it, leaving a passage along a front side of the housing for the lancets (2) to extend from the slat-shaped section (1) inside the housing out of said housing in the direction of the fabrics, in said warp direction.

4. Lancet holder for face-to-face weaving loom according to claim 3, characterised in that said housing is composed of two walled sections, a bottom section (9) and a top section (10), detachably fixed to each other and extending over the entire length of the housing.

5. Lancet holder for face-to-face weaving loom according to claim 4, characterised in that the two sections (9), (10) are fixed to each other along a rear side by detachable fixing means (11).

6. Lancet holder for face-to-face weaving loom according claim 5, characterised in that the two sections (9), (10) do not connect to each other over the entire length of the housing along a front side, so that an open front side is produced, along which the lancets (2) project from the housing.

7. Lancet holder for face-to-face weaving loom, according to claim 6, characterised in that a comb (4) is fixed to the front side of the housing—to at least one of the sections (9), (10)—while the teeth (8) of the comb (4) stand vertically in or along this open front side, and the lancets (2), each situated between two adjacent teeth (8), project from the housing.

8. Lancet holder for face-to-face weaving loom according to claim 7, characterised in that a top edge of the front side of the bottom section (9) supports the lancets (2).

9. Lancet holder for face-to-face weaving loom according to claim 7, characterised in that the slat-shaped section (1) rests closely against the comb (4).

10. Lancet holder for face-to-face weaving loom according to claim 4, characterised in that the two sections (9), (10) are each in a shape of a C-section, each with a short leg (9'), (10') and a longer leg (9'') and (10''), and the two sections (9), (10) are fixed with a flank of each of their long legs (9''), (10'') attached vertically against each other by detachable fixing means (11), the shape and dimensions of the sections (9), (10) and the place of fixing being such that the short leg (9') of the bottom section (9) is directed vertically upwards and the short leg (10') of the top section (10) is directed vertically downwards and lies in line with the short leg (9'), such that both the sections (9) and (10) enclose a symmetrical tubular space with the open front side between the two short legs (9') and (10').

11. Lancet holder for face-to-face weaving loom according to claim 10, characterised in that the comb (4) is fixed by the base (5) against a flank of the short leg (9') of the bottom section (9) by bolt means, while the teeth (8) extend in the direction of the short leg (10') of the top section (10) whereby each top edge of the teeth lie against a flank of said short leg (10') of the top section.

12. Lancet holder for face-to-face weaving loom according to claim 11, characterised in that the outside surfaces of the walls of the two sections (9), (10) are smooth with flat sections which merge into each other through rounded corners.

* * * * *